United States Patent [19]

Mathews

[11] 4,195,417

[45] Apr. 1, 1980

[54] DRYER DRUM WITH MAGNETIC SPOILER BARS

[75] Inventor: Gerald A. Mathews, Beloit, Wis.

[73] Assignee: Beloit Corporation, Beloit, Wis.

[21] Appl. No.: 4,908

[22] Filed: Jan. 19, 1979

[51] Int. Cl.[2] ..... F26B 13/08

[52] U.S. Cl. ..... 34/110; 34/119; 34/124; 165/76; 165/89

[58] Field of Search ..... 165/76, 89, 109; 34/110, 119, 124, 125; 432/118; 34/108; 366/228

[56] References Cited

U.S. PATENT DOCUMENTS

| | | | |
|---|---|---|---|
| 2,448,514 | 9/1948 | Butler | 165/89 |
| 3,217,426 | 11/1965 | Barnscheidt et al. | 34/110 |
| 3,724,094 | 4/1973 | Appel et al. | 34/124 |
| 3,808,700 | 5/1974 | Kraus | 34/124 |

FOREIGN PATENT DOCUMENTS

| | | | |
|---|---|---|---|
| 1231403 | 12/1966 | Fed. Rep. of Germany | 165/76 |
| 886705 | 1/1962 | United Kingdom . | |

*Primary Examiner*—Larry I. Schwartz

*Attorney, Agent, or Firm*—D. J. Veneman; G. A. Mathews; M. L. Gill

[57] ABSTRACT

A steam heated dryer drum having one or more spoiler bars secured against its inner shell wall to extend longitudinally and substantially parallel with the axis of rotation. The spoiler bars generate turbulence in the condensate to lower the resistance to heat transfer through the shell wall. No screws, bolts, rivets or the like, which would necessitate penetration of the shell wall, are required or used to secure the bars. In one embodiment, the bars themselves have a bridge-shaped cross sectional configuration and are made of a magnetic material. Their bridge legs form the north and south poles of the magnetic bar and have their ends contoured to correspond to the drum shell radius of curvature.

In another embodiment, magnets having a bridge-shaped cross section are used. These magnets are of a relatively short, finite length which is considerably less than either the spoiler bar or the drum shell lengths and have their inner bridge opening contoured to fit over and hold the spoiler bar which is non-magnetic and extends longitudinally along the roll shell wall for as far as desired. The magnets are then spaced along the bar so that less magnetic material can be used.

7 Claims, 4 Drawing Figures

DRYER DRUM WITH MAGNETIC SPOILER BARS

BACKGROUND OF THE INVENTION

This invention relates to rotatably mounted cylindrical dryer drums such as those used in the papermaking industry to dry the paper web. More particularly, the invention relates to a specific type of dryer drum wherein spoiler bars are mounted on the inner periphery of the dryer drum shell to interrupt the thin layer of condensate which forms thereon and diminishes the rate of heat transfer from the steam within the dryer drum to the outer drum shell surface. Still more particularly, this invention relates to the spoiler bars themselves and the manner in which they are mounted to the inner wall of the dryer drum shell.

The use of spoiler bars within a cylindrical dryer drum used to dry a moist web held against its surface is a relatively recent development in the papermaking industry. U.S. Pat. No. 3,217,426 (Barnscheidt et al) discloses the general concept of mounting spoiler bars against the inner periphery of a cylindrical dryer drum shell for the purpose of interrupting the thin layer of condensate to thereby decrease its effective thickness which increases the overall rate of heat transfer to the moist paper web. However, Barnscheidt et al mounted the longitudinally extending spoiler bars by a plurality of circumferential expansion rings to bias the spoiler bars against the inner periphery of the cylindrical shell. This was both expensive and very difficult to accomplish, particularly without special jigs, or when modifying an existing dryer drum in the paper mill, or both.

The importance or correctly locating the spoiler bars circumferentially around the inner wall of the dryer drum shell become more clear with the teaching of U.S. Pat. No. 3,724,094 (Appel et al) which advanced the art by disclosing a relationship between the circumferential spacing of adjacent spoiler bars and the internal diameter of the dryer drum.

The last development was the subject of U.S. Pat. No. 3,808,700 (Kraus) which relates to the concept of mounting the spoiler bars longitudinally in end abutting segments, each of which is screwed into the dryer drum to permit relative movement between the dryer drum shell and the spoiler bars due to differences in expansion caused by differences in material and/or differences in temperatures to which they are exposed.

Still another problem relating to the use of spoiler bars within dryer drums used to dry a moist paper web in the papermaking industry concerns the nature of the use of the dryer drums themselves. All dryer drums used in the papermaking industry are pressure vessels which must be certified in the United States under the ASME pressure vessel code. Steam is introduced under pressure because this increases the heat transfer through the dryer drum shell. Accordingly, anything done to the dryer drum which might tend to decrease its ASME pressure vessel rating is very undesirable. When the spoiler bars are mounted within the dryer drum with machine screws, as is the current practice, stress risers are created. In existing dryer drums on papermaking machines, this inherently decreases the strength of the dryer drum and may require the use of lower steam pressure during operation in order to operate within the ASME code. Alternately, on the new dryer drums on which it is contemplated to mount spoiler bars with machine screws, the drum cylinder must be made thicker in order to accommodate the design steam temperatures and pressures and still meet the ASME pressure vessel code. This is costly both from a manufacturing and operating standpoint. Further, the dryer drum shell outer surface is often refinished, particularly the surface of the large so-called Yankee dryers. This literally decreases the roll shell thickness and may shorten the life and/or operating effectiveness of the dryer drum if spoiler bars are attached to the inner wall of the shell with screws.

SUMMARY OF THE INVENTION

This invention obviates any problems associated with the mounting of spoiler bars by penetrating the dryer drum, such as by drilling and tapping mounting holes in it. In this invention, the spoiler bars are magnetically attached to the dryer drum. This requires no mounting holes whatsoever, thus eliminating both the time and expense of drilling the holes as well as the requirement for a stronger drum shell to accommodate the holes. In addition, the magnetically mounted spoiler bars remain attached in the desired location despite relative differences in thermal expansion between the spoiler bars and dryer drum shell. In existing dryers in paper mills, little or no special preparation need be made in order to mount these magnetic spoiler bars to improve the thermal conductivity of the dryer shell. Also, the spoiler bars can be relatively quickly installed by unskilled personnel without a lot of special fixtures, brackets, jigs and tools.

In the preferred embodiment, the magnetic material is Alnico V. Either the bar itself can take the form of a bridge-shaped cross sectional configuration, which is available commercially, or a nonmagnetic, substantially rectangular shaped bar can be used which in turn is held against the dryer drum shell inner wall by one or more bridge shaped magnets which are contoured to fit over the bar to hold it in he desired position. This permits the use of a smaller amount of magnetic material (i.e. fewer magnets) to secure the spoiler bars to the inner periphery of the dryer drum shell. It is also easier since the non-magnetic spoiler bars can be positioned and aligned longitudinally along the roll shell wall before being fastened by the straddling magnets.

Accordingly, it is an object of this invention to provide a dryer drum having spoiler bars which utilize no interior bracing or require no interruption of the dryer drum shell's inner wall surface for their mounting.

Another object of the invention is to provide a dryer drum with spoiler bars wherein the spoiler bars can be installed or removed without affecting the pressure rating of the dryer drum.

Still another object of the invention is to provide a dryer drum having spoiler bars wherein the spoiler bars can be installed and relocated in the field while the drum is in operating position on the web drying machine.

An important object of this invention is to provide a dryer drum having spoiler bars which are attached to the inner surface of the drum shell wall magnetically.

These and other objects, features and advantages of the invention will become readily apparent to those skilled in the art when the following description of the preferred embodiments are read in conjunction with the attached drawings.

IN THE DRAWINGS

DESCRIPTION OF THE PREFERRED EMBODIMENTS

In a papermaking machine, a plurality of rotatably mounted dryer drums are utilized to dry the newly formed moist paper web which is supported on, and sometimes held against, the outer surface as it travels over a portion of each dryer drum's periphery. While the paper web is in contact with the dryer drum shell, it receives heat from the steam introduced into the center of the drum and the paper is thereby dried. As the steam gives up its heat, water condenses and a layer of condensate begins to build on the inner surface of the roll shell. This condensate is removed by a scoop which usually remains fixed within the dryer drum and collects condensate by virtue of its movement relative to the rotating roll shell. Sometimes, a plurality of condensate collectors are used which rotate with the roll shell and operate to remove condensate which collects on the lower inner surface of the rotating dryer drum. The manner in which steam is introduced into the dryer drums, and the condensate is removed, are well known in the papermaking industry, as are the means for mounting and rotating the dryer drums themselves, and will not be discussed further as they form no part of this invention. In fact, as used herein, the term "dryer drum" is intended to designate a complete roll which forms a pressure vessel. This roll may be an ordinary 5 or 6 foot diameter papermaking machine dryer, or a large Yankee dryer which typically ranges from about 12 feet to about 20 feet in diameter.

Figure 1:
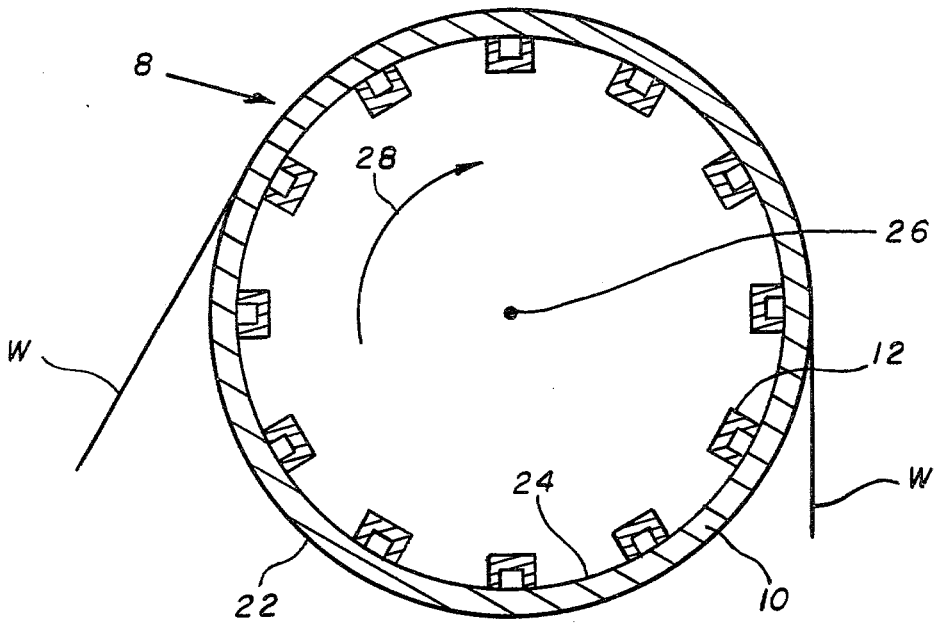
FIG. 1 is a cross sectional end view of a dryer drum showing the position of the bridge-shaped magnets attached to the inner wall of the shell.

As shown in FIG. 1, a dryer drum 8 has a roll shell 10 in which a plurality of bridge-shaped magnetic spoiler bars 12 are mounted on the inner surface 12 to extend longitudinally substantially parallel with the axis of rotation 26. The term "bridge-shaped" is commonly used in the magnet trade to denote an end configuration shape that most people would refer to as a "horseshoe" magnet. The bridge-shaped magnet used in this invention might perhaps be best distinguished from the common "horseshoe" magnet by its relatively short legs and having its front and back sides parallel and spaced apart by several inches or feet which gives the impression that the magnet is a segment taken from a much longer magnetic bar.

The use of spoiler bars 12 within a dryer drum to interrupt the condensate layer and thus improve the heat transfer characteristics of the drum are now generally appreciated in the papermaking industry. A thorough discussion of this phenomenon is contained in the aforementioned U.S. Pat. No. 3,724,094, the teaching of which is incorporated herein by reference.

Figure 2:
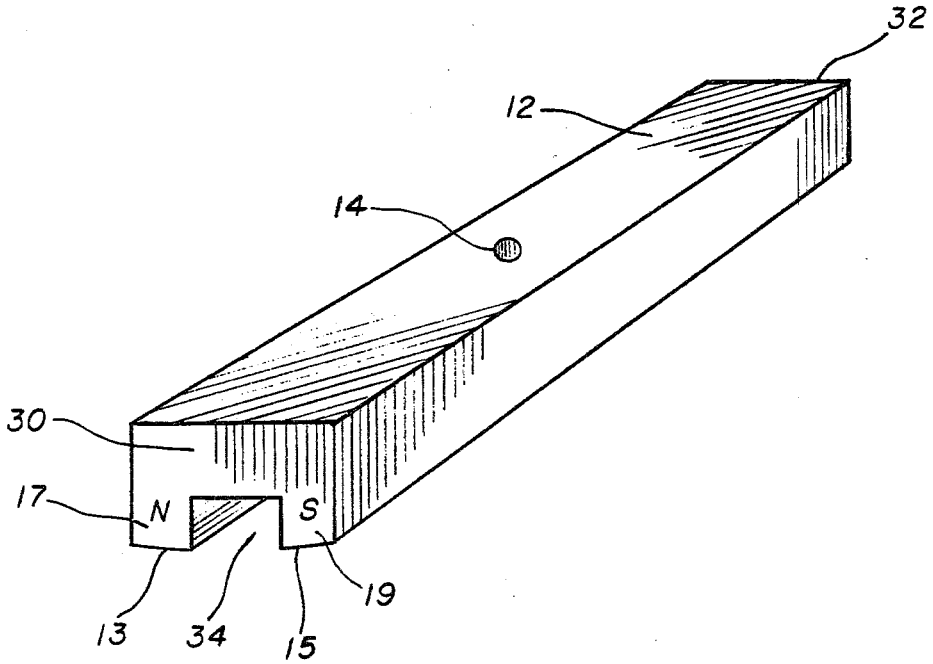
FIG. 2 is a perspective view of a bridge-shaped magnetic spoiler bar.

FIG. 2 illustrates a spoiler bar made of magnetic material and shaped in the bridge-shaped configuration. Front and rear faces 30, 32 are shown as a parallel butt ends, although there is no requirement that they must be parallel. Legs 13, 15 of the magnet form the north and south magnetic poles and extend longitudinally along the length of magnet 12. One or more holes 14 may be drilled in the top of the magnet to connect the inner space 34 with the exterior of the magnet so that any condensate that forms there may drain to the inside of the dryer drum for eventual removal.

Figure 3:
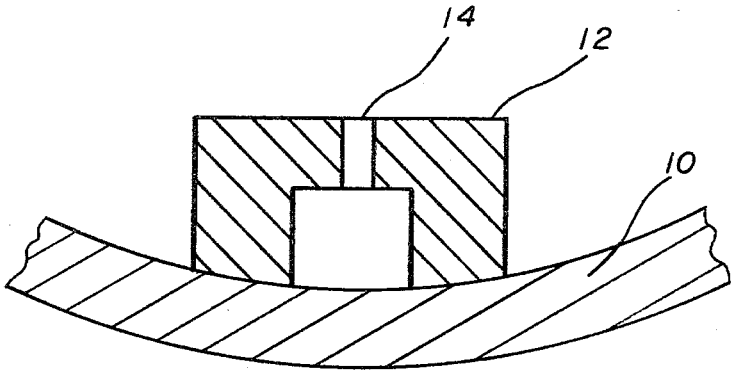
FIG. 3 is an end view of a bridge-shaped spoiler bar shown in position within the dryer drum.

The bridge-shaped magnet configuration is preferred because both the north and south poles of the magnet contact the dryer drum shell 10 which then functions as the "keeper". By covering the poles of each magnet with a nonmagnetized conductor (i.e. the dryer drum shell 10), the flux paths between poles of each magnetic spoiler bar are closed which eliminates the demagnetizing effect which occurs when a magnet's poles are left exposed in an air gap. The ends 13, 15 of the legs 17, 19 forming the north and south poles, respectively, of the magnetic spoiler bar 10 are curved to form an arc having a circular radius equal to the radius of the inner surface 24 of the dryer drum shell 10. This is shown in FIG. 3. In addition, the leg edges 13, 15 are finished to have a smooth surface to enhance its contact with the roll shell. Typically, the inner surface 24 of the roll shell has a smooth finish on the order of about 200–250 microinches. The edges 13, 15 of the spoiler bars need not have the same surface finish, but their finish should be sufficiently smooth to ensure a secure attachment.

Figure 4:
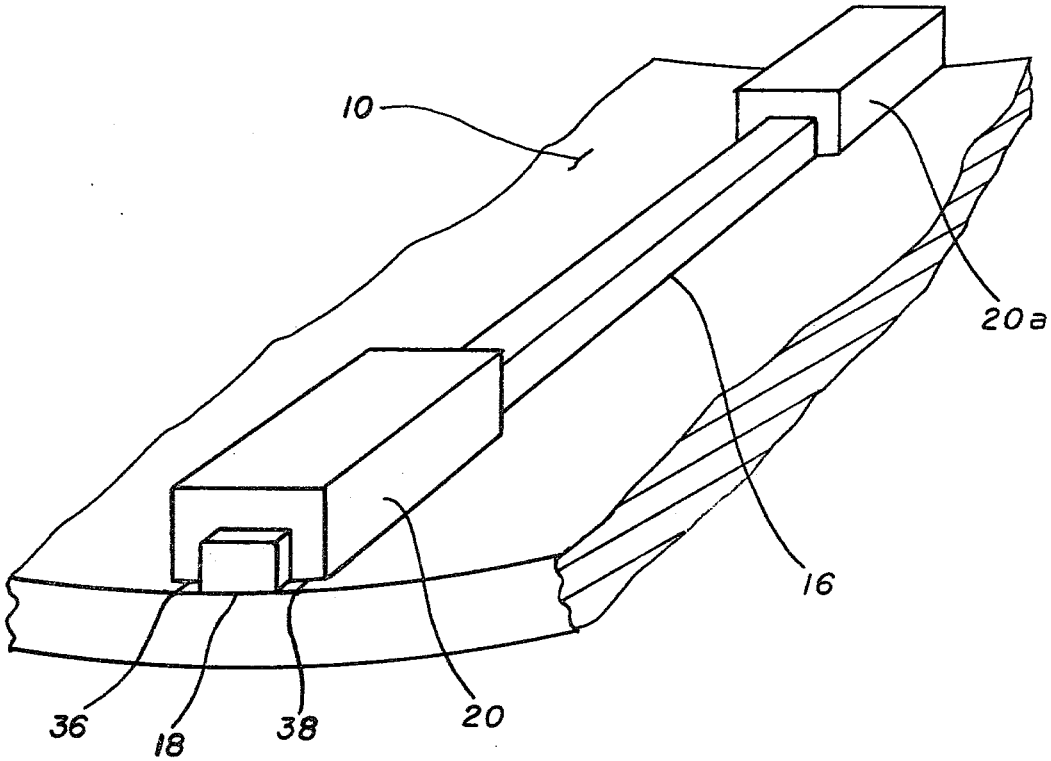
FIG. 4 is a perspective view of another configuration wherein the spoiler bar is not magnetized but is held into position with one or more bridge-shaped magnets.

FIG. 4 illustrates a slightly different embodiment wherein magnets **20, 20*a* are of the same bridge-shaped configuration as used for the spoiler bars shown in FIGS. 1–3. However, in FIG. 4, magnets 20, 20*a* are used to hold a nonmagnetic spoiler bar 16 to the inner surface of a dryer drum shell 10. By spacing out a plurality of magnets 20, 20*a*, 20*b*, etc. as needed to hold the spoiler bar 16 to the dryer drum shell, less magnetic material is required and the alignment and installation of the spoiler bar is facilitated since its position can be adjusted before it is fastened to the inner shell wall. This type of mounting also facilitates the removal of the spoiler bars in the field as well as changing the circumferential distances between adjacent spoiler bars to accommodate changes in operating conditions should this become necessary. As with the magnetic spoiler bar 12, the lower surfaces 18 and 36, 38, on the nonmagnetic spoiler bar and magnet legs, respectively, are contoured to fit the inner surface 24** of the dryer drum shell. The principles of attaching the spoiler bars is the same in both cases as is their method of operation.

The preferred magnetic material is Alnico V. The word "Alnico" is an acronyn for its metallurgical components, namely aluminum, nickel and cobalt. It is considered to be the most powerful commercially available magnet. In addition, although all magnets lose some of their magnetism shortly after they are formed, typically about $\frac{1}{3}$%–2%, and become less powerful at elevated temperatures, Alnico V is the least affected by temperature of any of the Alnico family of magnets. While Alnico V is the preferred magnetic material for securing the spoiler bars to the dryer drum shell, which is made of a gray cast iron, it is contemplated that other magnetic materials, such as ceramics, could be used with satisfactory results.

Essentially, the magnets must be capable of operating continuously in the temperatures within the dryer drum, which typically are in the 300° F.–400° F. range. Steam pressure may range as high as about 160 psig, and typically about 125 psig. These magnetic spoiler bars are intended to be used in all types of heated, rotating web dryers, including the ordinary 5 and 6 ft. dryers on paper machines as well as the so-called Yankee dryers on paper making machines which are usually at least 12 ft. in diameter and may be as much as 20 ft. in diameter.

It is also contemplated that condensible fluids other than steam can be used and that the magnetic spoiler bars could be used in drying drums used in other industries to dry things other than paper webs. For example, the dryer drums could be used in the textile or food processing industries.

What is claimed is:

1. In a dryer drum having a cylindrical shell and adapted to rotate and dry material on the exterior surface of the shell as a condensible fluid within the drum condenses and gives up heat through the shell, the shell having a plurality of spoiler bars positioned on its inner surface to interrupt and reduce the effective thickness of the condensate, which is urged thereagainst by the centrifugal forces induced during rotation, and thereby enhance heat transfer through the dryer drum shell, the improvement wherein:

the spoiler bars are magnetically secured to the dryer drum shell.

2. The dryer drum as set forth in claim 1, wherein:

at least one of the spoiler bars comprises a bridge-shaped magnet which extends longitudinally along the inner surface of the shell substantially parallel to the drum axis of rotation.

3. The dryer drum as set forth in claim 1, wherein:

at least one of the spoiler bars comprises a bar of non-magnetic material, each of which bars are secured to the dryer drum shell by at least one bridge-shaped magnet having a pair of legs, each forming one of the magnetic poles which straddle the spoiler bar and contact the shell inner surface to thereby secure the bar in the desired position.

4. The dryer drum as set forth in claim 1, wherein:

the material providing the magnetic forces is Alnico V.

5. The dryer drum as set forth in claim 1, wherein:

the condensible fluid is steam.

6. In a dryer drum having a cylindrical shell and adapted to rotate and dry material on the exterior surface of the shell as a condensible fluid within the drum condenses and gives up heat through the shell, the shell having a plurality of spoiler bars positioned on its inner surface to interrupt and reduce the effective thickness of the condensate, which is urged thereagainst by the centrifugal forces induced during rotation, and thereby enhance heat transfer through the dryer drum shell, the improvement wherein:

each of the spoiler bars comprise a bridge-shape magnet having a pair of legs forming the north and south magnetic poles, respectively;

each of the spoiler bars extends longitudinally along the roll shell length substantially parallel to the axis of dryer drum rotation, each spoiler bar leg being curved to match the radius of the inner surface of the cylindrical shell to enhance their contact with the inner surface of the shell whereby the spoiler bars are magnetically secured into position in the dryer drum.

7. The dryer drum as set forth in claim 6, wherein:

the magnetic material is Alnico V.

* * * * *